United States Patent [19]

Nichols et al.

[11] Patent Number: 4,642,837

[45] Date of Patent: Feb. 17, 1987

[54] BROOM HAVING INTERLOCKING COMPONENTS

[75] Inventors: Charles Nichols, Woodridge; John Howard, West Chicago, both of Ill.

[73] Assignee: The Drackett Company, Cincinnati, Ohio

[21] Appl. No.: 767,559

[22] Filed: Aug. 20, 1985

[51] Int. Cl.[4] ..... A46B 9/08

[52] U.S. Cl. ..... 15/171; 15/145; 15/146; 15/176; 403/290; 403/342

[58] Field of Search ..... 15/171, 145, 146, 176, 15/175, 159 R, 147 R, 144 B, 229 A; 403/290, 320, 342

[56] References Cited

U.S. PATENT DOCUMENTS

| | | | |
|---|---|---|---|
| 689,941 | 12/1901 | Wilson . | |
| 1,820,703 | 8/1931 | Hungerford | 403/342 X |
| 1,838,448 | 12/1931 | Pomfret . | |
| 2,444,758 | 7/1948 | Stillbach | 15/145 |
| 2,893,034 | 7/1959 | Jones | 15/146 |
| 2,902,704 | 9/1959 | Schwartz | 15/229 |
| 3,380,097 | 4/1968 | Pharris | 15/145 |
| 3,624,591 | 11/1971 | Buberniak | 403/342 X |
| 3,682,516 | 8/1972 | Savage | 306/30 |
| 4,373,828 | 2/1983 | Sartori | 403/263 |
| 4,384,383 | 5/1983 | Bryant | 15/159 R |
| 4,541,139 | 9/1985 | Jones et al. | 15/171 |

*Primary Examiner*—Peter Feldman
*Attorney, Agent, or Firm*—Charles J. Zeller

[57] ABSTRACT

The broom assembly of the present invention comprises of a broom shroud having an opening in its top, said broom shroud including resilient means depending inwardly toward said opening; bristle retaining means including ferrule means integral therewith and extending upwardly therefrom, said ferrule means adapted to receive said resilient means; a broom handle removably received in said ferrule, and fastening means engaging the ferrule means, whereby said resilient means is flexed inwardly against the handle upon tightening said fastening means.

12 Claims, 6 Drawing Figures

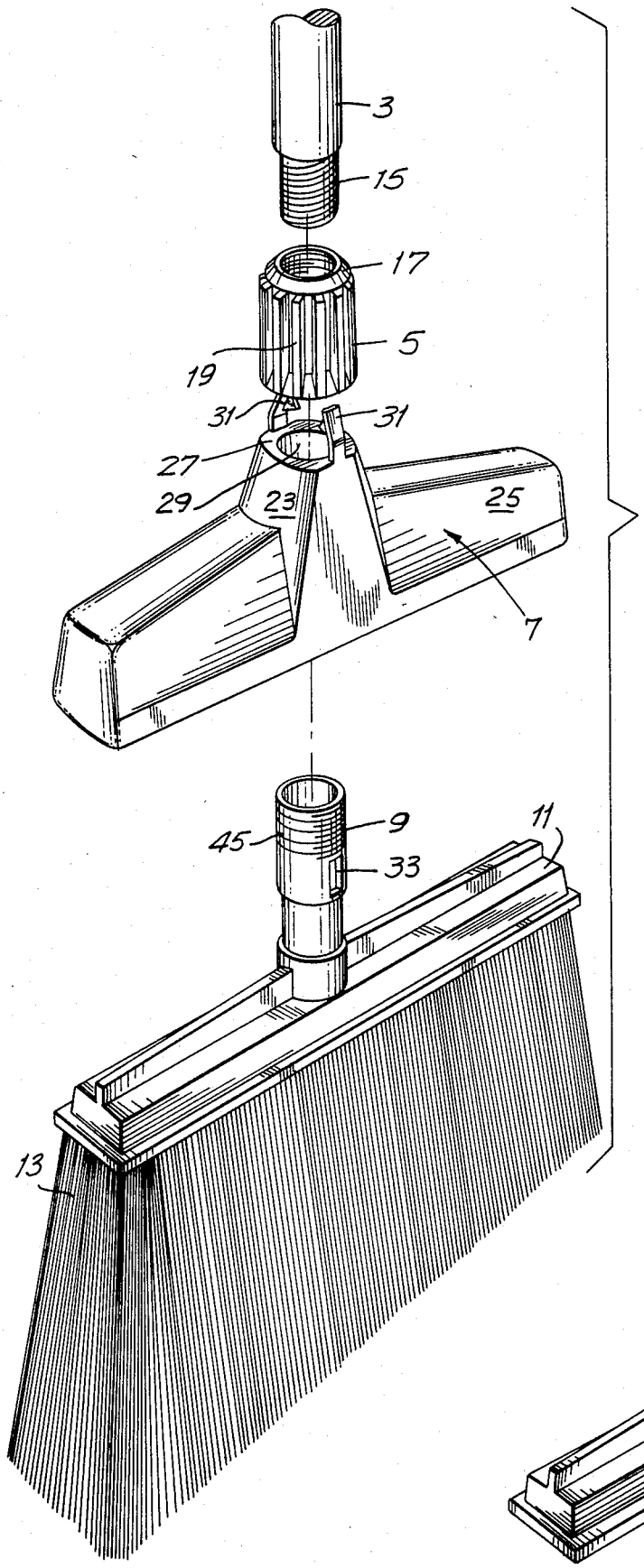
FIG. 1
FIG. 2
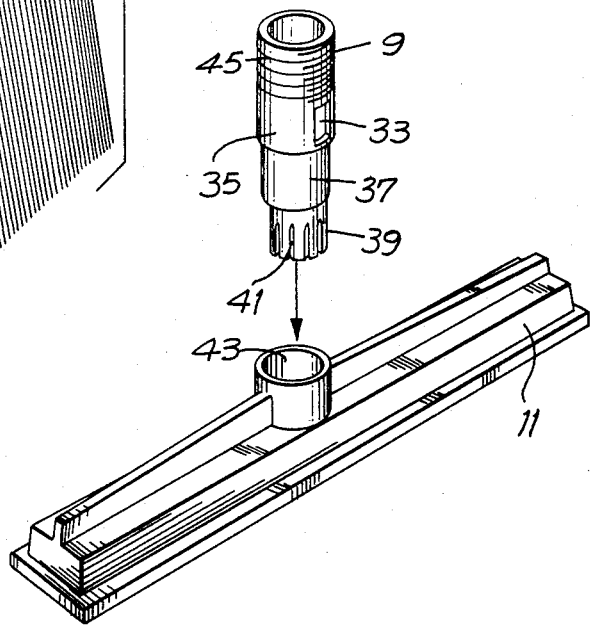

BROOM HAVING INTERLOCKING COMPONENTS

FIELD OF INVENTION

This invention relates to a broom assembly. More particularly, it concerns an assembly of this character in which the various parts are readily replaceable in the event they are broken or otherwise become unserviceable.

BACKGROUND OF THE INVENTION

Brooms that are employed in industrial and commercial establishments are subject to a great deal of wear and tear. In addition, in light of the jobs that they are called on to perform, they are likely to take a substantial amount of abuse that often result in the breakage or damaging of the parts. Industrial or commercial brooms are inclined to be more expensive than the ordinary household brooms and consequently, their complete replacement when they are damaged can become a costly matter for a business establishment.

SUMMARY OF THE INVENTION

It is an object of the present invention to provide a broom assembly in which the individual elements may be replaced should one or more of them break without having to replace the whole broom.

Other and more detailed objects of this invention will be apparent from the following description, drawings and claims a summary of which follows.

The broom assembly of the present invention comprises a broom shroud having an opening in its top, said broom shroud including upwardly extending resilient means disposed inwardly toward the opening; bristle retaining means including broom handle receiving means integral therewith and extending upwardly therefrom, said broom handle receiving means passing through said opening in the top of the broom shroud and receiving said resilient means; a broom handle removably received into said broom handle receiving means, and fastening means engaging the broom handle receiving means, whereby said resilient means is flexed inwardly against the handle when said fastening means is tightened about said broom handle receiving means.

BRIEF DESCRIPTION OF THE DRAWINGS

This invention will be described with the aid of the appended drawings in which:

FIG. 1 is an exploded view of a broom assembly embodied in the present invention;

FIG. 2 is an assembly drawing of the bristle block and broom handle socket shown in FIG. 1 (the bristles having been removed) illustrating the manner in which the broom handle socket is to be secured to the bristle block;

DETAILED DESCRIPTION OF THE PREFERRED EMBODIMENT

Figure 3:
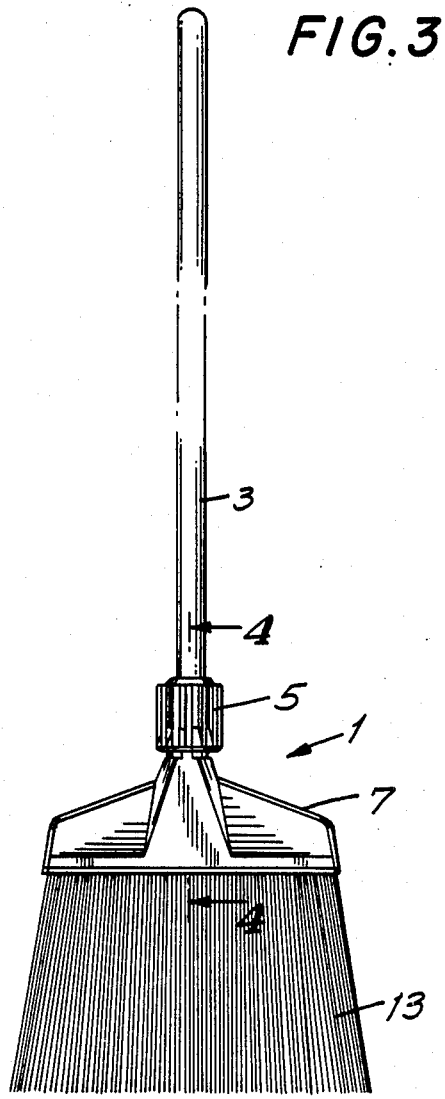
FIG. 3 is a front elevation of the broom assembly shown in FIGS. 1 and 2 after all the parts have been assembled.

Referring now to the drawings wherein the same numeral designates the same structure in the various views, the broom assembly is shown generally at 1, and comprises broom handle 3, broom handle socket cap 5 and broom shroud 7. In addition, the broom assembly includes a broom handle socket 9 that is mounted in a bristle block 11 in a manner described in more detail below. Secured to the bristle block 11 and depending therefrom are a plurality of bristle tufts 13. These are secured in bristle block 11 in a manner well known to those skilled in this art and does not form part of this invention.

As best seen in FIG. 1, the broom handle 3 is provided at its inner end with an external threaded surface 15. When broom handle 3 is mounted in the assembly, it is screwed into an internal thread provided on the interior surface of the broom handle socket 9 in a manner described in more detail below.

Figure 4:
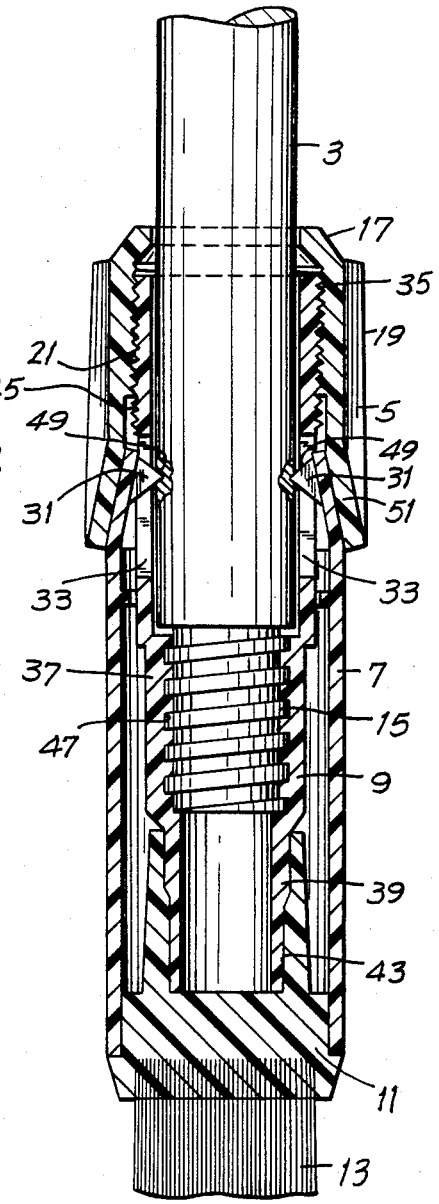
FIG. 4 is a partial, vertical and cross-sectional view taken along line 4—4 of FIG. 3 showing the internal relationship of the parts when assembled.
Figure 5:
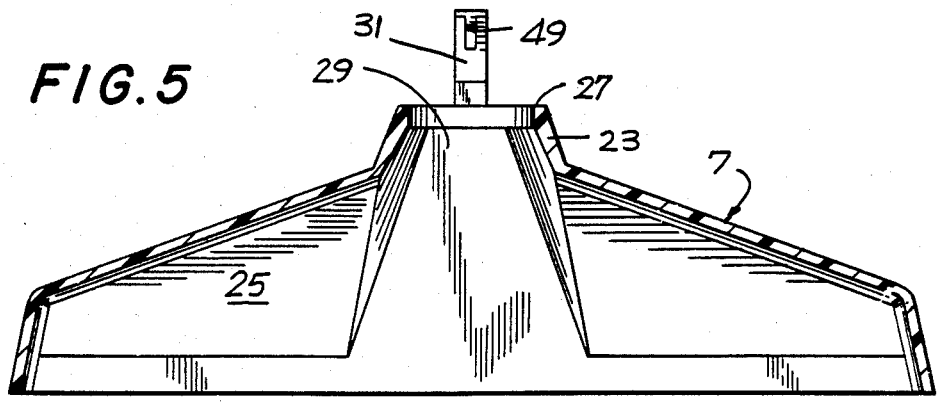
FIG. 5 is a median, vertical cross-sectional of the broom, shroud forming part of this invention.
Figure 6:
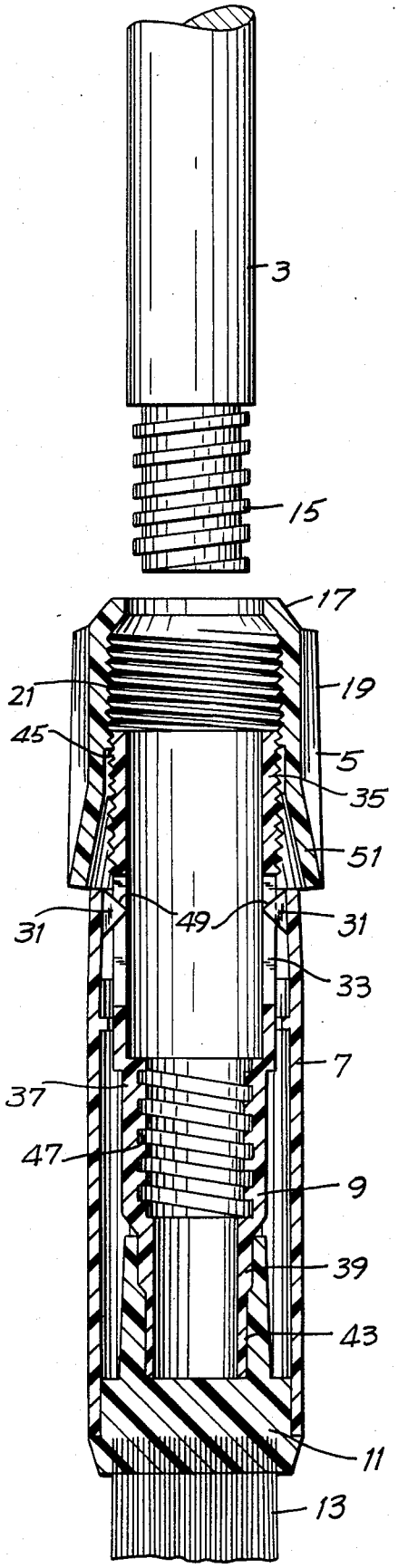
FIG. 6 is an exploded, partial, vertical cross-sectional view taken along line of 4—4 of FIG. 3 showing the internal relationship of the parts when the cap is loosely attached to the handle socket and prior to insertion of the broom handle.

Broom handle socket cap 5 is generally cylindrical in shape and is provided with chamfered lip 17. The outer surface of the broom handle socket cap 5 has a fluted surface 19 which provides a grip for screwing and unscrewing cap 5 onto the outer threaded surface of broom handle socket 9, also described in more detail below. To accomplish this, there is also cut into the upper inner surface of cap 5 a threaded inner surface 21, as is most clearly shown in FIGS. 4 and 6. As also shown in FIGS. 4 and 6, the lower interior periphery of the cap 5 is a chamfered surface 51, hereinafter referred to as the "cam surface 51", the purpose of which is described more fully below.

Shroud 7 is generally hollow in construction having a turret portion 23 and a body portion 25. Extending across the top of turret portion 23 is a roof 27 through which is provided a central opening 29. Extending upwardly from roof 27 is a pair of oppositely disposed tabs including as their uppermost portions inwardly angled gripping fingers 31 that are passable through slots 33 cut into the outer surface of the broom handle socket 9, said fingers 31 including on the interior surfaces thereof inwardly disposed triangular teeth 49.

Handle socket 9 is constructed so as to have three separate portions, an upper portion 35, a middle portion 37 and a lower portion 39. These are designed so as to have outer diameters that are decreasing in size. Lower portion 39 is preferably provided with a plurality of circumferentially disposed ribs 41. These serve to improve retention of the handle socket 9 when it is affixed into collar 43 of bristle block 11. Upper portion 35 is provided with external threaded surface 45 which mates with internal threaded surface 21 of cap 5 when the latter is screwed into place. Cut into the inner face of middle section 37 of handle socket 9 is a threaded inner surface 47. This mates with the external threaded surface 15 of broom handle 3 when the latter is screwed into place. As previously indicated, upper portion 35 of handle socket 9 is provided with a pair of outer slots 33 that receive the flexible gripping fingers 31 of the tabs.

Bristle block 11 is conventional in shape and construction. Bristle tufts 13 are secured to the lower surface of bristle block 11 in any suitable fashion well-known to those skilled in this art.

In putting together the broom assembly of the present invention, the broom handle socket 9 is first inserted into collar 43 of bristle block 11. Handle socket 9 may be held in bristle block 11 in any conventional manner, e.g., by a friction fit, but preferably is glued, sonically welded, or otherwise permanently secured in collar 43.

Shroud 7 is then mounted onto the bristle block handle socket assembly so that the cylindrical portions of handle socket 9 pass through the opening 29 in turret 23. As handle socket 9 passes through this opening, it deflects laterally resilient gripping fingers 31. It then proceeds upwardly until the slots 33 are in alignment therewith, with the triangular teeth 49 projecting inwardly from the inner surface of fingers 31. At this point, the gripping fingers 31 that had been displaced outwardly snap back into position into slots 33 thereby positioning the fingers 31 within the slots 33.

Cap 5 may then be loosely attached to the broom handle socket 9 by engaging several threads of the threaded surface 21 with several threads of the threaded surface 45, as illustrated in FIG. 6. Tightening of the cap 5 to such extent that the cam surface 51 on the interior wall of the cap 5 substantially engages the flat exterior surfaces of the gripping fingers 31 is to be avoided, to prevent camming the fingers 31 towards the interior of handle socket 9.

Broom handle 3 may then be inserted in through the opening in cap 5 inasmuch as the fingers 31, particularly the teeth 49, have not been flexed or cammed into an interference position in the handle socket. The broom handle 3 is then fastened to the handle socket 9 by engaging the threads 15 of the handle 3 and the threaded surface 47 of the broom handle socket 9. Cap 5 is then tightened to complete the assembly, as is shown in FIG. 4. By tightening the cap 5, the cam surface 51 mates with the flat exterior surface of the gripping fingers 31 and flexes them inwardly, thereby causing the teeth 49 to bite into the broom handle 3.

What is claimed is:

1. A broom assembly comprising:

(a) a bristle block having a plurality of bristle tufts secured thereto and extending downwardly therefrom;

(b) a broom handle socket secured to said bristle block and extending upwardly therefrom and forming therewith a bristle block-broom handle socket subassembly, said socket being adapted to engage and secure a broom handle and a broom handle socket cap;

(c) a broom shroud having an opening therein, said shroud being adapted to slide over said bristle block-broom handle socket subassembly through said opening in said shroud, said shroud also being provided with resilient gripping means, said broom handle socket including passage means to receive said resilient gripping means;

(d) said broom handle being provided at one end thereof with securing means that mate with securing means in said socket, whereby said broom handle may be fastened into said socket, and (e) said broom handle socket cap having an opening therethrough to permit the insertion therein of a broom handle, said cap opening including cam surface means cooperating with said resilient gripping means and also being provided with securing means that cooperate with mating securing means on said socket, whereby said cap may be tightened onto said socket and thereby cause said resilient gripping means passing through said passage means to engage said broom handle.

2. A broom assembly according to claim 1 wherein said broom handle socket is provided with an external threaded surface for engaging said broom handle cap and an internal threaded surface for engaging said broom handle, said cap having an internal threaded surface that cooperates with said external threaded surface of said socket and said broom handle has an external threaded surface that cooperates with said internal threaded surface of said socket.

3. A broom assembly according to claim 2 wherein said resilient gripping means comprises a plurality of resilient fingerlike projections that extend upwardly from an upper surface of said shroud.

4. A broom assembly according to claim 3 wherein said socket is provided with cut-out portions in its outer surface that engage said fingerlike projections when the parts are assembled.

5. A broom assembly according to claim 4 wherein said socket cap is provided with an outer fluted surface to facilitate the gripping and turning of said socket cap with the hand.

6. A broom assembly comprising a broom shroud having a top with an opening therethrough; resilient gripping means extending upwardly from the top of said broom shroud; bristle retaining means; broom handle receiving means integral with and extending upwardly from said bristle retaining means, said broom handle receiving means including means for receiving the resilient gripping means and said broom handle receiving means passing through the opening in the top of the broom shroud, with the resilient gripping means registering with the means for receiving the resilient gripping means and with said broom shroud being superposed relative to said bristle retaining means; a broom handle releasably connected to the broom handle receiving means, and fastening means engaging the broom handle receiving means, whereby said resilient gripping means is flexed inwardly against the broom handle when the fastening means is tightened about the broom handle receiving means.

7. The broom assembly of claim 6 wherein the broom handle receiving means is a ferrule, said means for receiving the resilient gripping means being at least one slot therethrough.

8. The broom assembly of claim 7 wherein the resilient means is at least one fingerlike projection integral with the top of the broom shroud.

9. The broom assembly of claim 8 wherein there is a plurality of said fingerlike projections received in an equal number of slots.

10. The broom assembly of claim 9 wherein there are two fingerlike projections.

11. The broom assembly of claim 8 wherein the fingerlike projection includes an inwardly positioned triangular projection.

12. The broom assembly of claim 8 wherein the fastening means is a broom handle receiving means cap having an opening therethrough to permit the insertion therein of the broom handle, the cap opening including cam surface means cooperating with said resilient gripping means to cause same to flex inwardly and also being provided with securing means that cooperate with mating securing means on the ferrule.

* * * * *